US010854124B2

(12) United States Patent
Yang et al.

(10) Patent No.: US 10,854,124 B2
(45) Date of Patent: Dec. 1, 2020

(54) DISPLAY PANEL AND DISPLAY DEVICE INCLUDING THE SAME

(71) Applicant: Shanghai Tianma AM-OLED Co., Ltd., Shanghai (CN)

(72) Inventors: Yang Yang, Shanghai (CN); Shuo Tang, Shanghai (CN); Bojia Lv, Shanghai (CN); Xiangzi Kong, Shanghai (CN); Jun Li, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 16/459,386

(22) Filed: Jul. 1, 2019

(65) Prior Publication Data

US 2020/0312209 A1 Oct. 1, 2020

(30) Foreign Application Priority Data

Mar. 29, 2019 (CN) ..... 2019 1 0256049

(51) Int. Cl.
*G09G 3/20* (2006.01)

(52) U.S. Cl.
CPC ..... *G09G 3/20* (2013.01); *G09G 2300/0426* (2013.01); *G09G 2310/0267* (2013.01); *G09G 2310/0297* (2013.01); *G09G 2320/0233* (2013.01)

(58) Field of Classification Search
CPC ..... G09G 2310/0297; G09G 3/20; G09G 2300/0426; G09G 2320/0233; G09G 2310/0267
See application file for complete search history.

(56) References Cited

U.S. PATENT DOCUMENTS

2010/0277443 A1* 11/2010 Yamazaki ..... G09G 3/3225 345/204
2015/0022770 A1* 1/2015 Yamaguchi ..... G02F 1/13454 349/139
2019/0259347 A1* 8/2019 Furuta ..... G09G 3/3677

FOREIGN PATENT DOCUMENTS

CN 107342036 A 11/2017

* cited by examiner

*Primary Examiner* — Muhammad N Edun
(74) *Attorney, Agent, or Firm* — Alston & Bird LLP

(57) ABSTRACT

A display panel has a display area and a non-display area surrounding the display area. The display area has a first side and a second side opposite to the first side, and includes: a hollow area having first and second edges; and first to fourth display areas. The display panel includes: a driving chip arranged in the non-display area close to the first side; first data lines arranged in the first display area; second data lines arranged in the second display area; third data lines arranged in the third display area; and fourth data lines arranged in the fourth display area. The first edge is close to the driving chip and the second edge is away from the driving chip, and each second signal line is connected to at least two third data lines through a signal switching circuit.

21 Claims, 14 Drawing Sheets

DISPLAY PANEL AND DISPLAY DEVICE INCLUDING THE SAME

CROSS-REFERENCE TO RELATED APPLICATIONS

The present disclosure claims priority to Chinese Patent Application No. CN201910256049.6, filed on Mar. 29, 2019, the content of which is incorporated herein by reference in its entirety.

TECHNICAL FIELD

The present disclosure relates to the technical field of display technologies, and in particular, to a display panel and a display device including the same.

BACKGROUND

With newer display technologies continuously replacing old ones, consumers' desire for display panel shapes are no longer limited to display panels being rectangles or circles. They expect display areas meet practical needs. For example, to achieve a cellphone's higher screen occupancy ratio to accommodate devices such as a front camera, an earpiece, a light sensor and the like, a part of the display panel is cut out to form a special area. However, such a display panel is not a good way to increase the screen occupancy ratio. In order to further increase the screen occupancy ratio, people have designed a non-display hole in a display area of the display panel or outside of the display panel. In these cases, a data line may be cut off by the non-display hole. In order to allow normal transmission of data signals, this cut off data line needs to wind around a periphery of the non-display hole. It is also necessary to leave space around the periphery of the non-display hole for winding of the data line in the non-display area, which increases the area of the non-display area of the display panel and thus prevents the screen occupancy ratio of the display panel from increasing.

SUMMARY

In view of this, embodiments of the present disclosure provide a display panel and a display device including the same, so as to solve the abovementioned technical problems.

In an aspect, an embodiment of the present disclosure provides a display panel. The display panel has a display area and a non-display area surrounding the display area. The display area has a first side and a second side disposed opposite to the first side, and the display area includes: a hollow area having a first edge and a second edge; a first display area extending from the first side of the display area to the second side of the display area; a second display area extending from the first side of the display area to the second edge of the hollow area; a third display area extending from the second edge of the hollow area to the second side of the display area; and a fourth display area extending from the first side of the display area to the first edge of the hollow area. The display panel includes: a driving chip arranged in the non-display area close to the first side of the display area; first data lines arranged in the first display area; second data lines arranged in the second display area; third data lines arranged in the third display area; and fourth data lines arranged in the fourth display area. The first edge of the hollow area is close to the driving chip and the second edge of the hollow area is away from the driving chip. One of the second data lines is connected to n third date lines of the third date lines through a set of signal switching circuits, n is an integer equal or larger than 2.

BRIEF DESCRIPTION OF DRAWINGS

In order to more clearly illustrate technical solutions in embodiments of the present disclosure, the accompanying drawings used in the embodiments are briefly introduced as follows. It should be noted that the drawings described as follows are merely part of the embodiments of the present disclosure, other drawings can also be acquired by those skilled in the art without paying creative efforts.

DESCRIPTION OF EMBODIMENTS

For better illustrating technical solutions of the present disclosure, embodiments of the present disclosure will be described in detail as follows with reference to the accompanying drawings.

It should be noted that, the described embodiments are merely exemplary embodiments of the present disclosure, which shall not be interpreted as providing limitations to the present disclosure. All other embodiments obtained by those skilled in the art without creative efforts according to the embodiments of the present disclosure are within the scope of the present disclosure.

The terms used in the embodiments of the present disclosure are merely for the purpose of describing particular embodiments but not intended to limit the present disclosure. Unless otherwise noted in the context, the singular form expressions "a", "an", "the" and "said" used in the embodiments and appended claims of the present disclosure are also intended to represent plural form expressions thereof.

It should be understood that the term "and/or" used herein is merely an association relationship describing associated objects, indicating that there may be three relationships, for example, A and/or B may indicate that three cases, i.e., A existing individually, A and B existing simultaneously, B existing individually. In addition, the character "/" herein generally indicates that the related objects before and after the character form an "or" relationship.

It should be understood that, although the display area may be described using the terms of "first", "second", "third", etc., in the embodiments of the present disclosure, the display area will not be limited to these terms. These terms are merely used to distinguish symmetric axes from one another. For example, without departing from the scope of the embodiments of the present disclosure, a first display area may alternatively be referred to as a second display area, similarly, a second display area may alternatively be referred to as a first display area.

As mentioned in the background, in order to further increase a screen occupancy ratio, researchers design a non-display hole in the display area of the display panel or at a side of the display panel. In this case, a data line will be cut off by the non-display hole. In order to allow normal transmission of data signals, the data line needs to be wound around a periphery of the non-display hole. It is also necessary to leave a space around the periphery of the non-display hole for winding of the data line in the non-display area, which increases an area of the non-display area of the display panel and thus prevents the screen occupancy ratio of the display panel from increasing.

Figure 1:
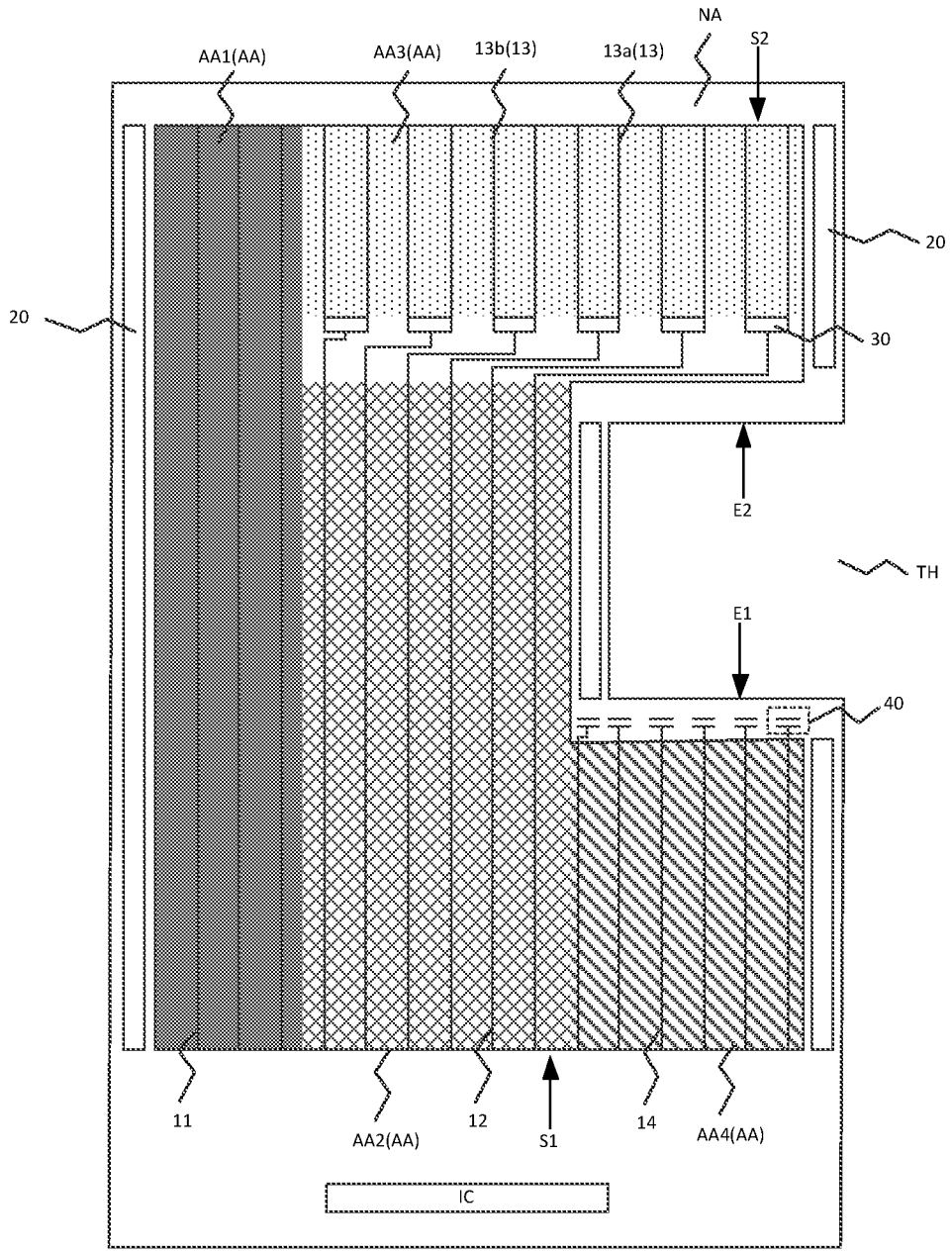
FIG. 1 is a schematic diagram of a display panel according to an embodiment of the present disclosure.

FIG. 1 is a schematic diagram of a display panel according to an embodiment of the present disclosure. With reference to FIG. 1, an embodiment of the present disclosure provides a display panel having a display area AA and a non-display area NA surrounding the display area AA. The display area AA has a first side S1 and a second side S2 opposite to the first side S1. The display panel includes a driving chip IC located in the non-display area NA that is close to the first side of the display area AA. Taking FIG. 1 as an example, a lower side is the first side S1 of the display area AA and an upper side opposite to the lower side is the second side S2 of the display area AA. The display panel has a hollow area TH located in the display area AA. The hollow area TH has a first edge E1 close to the driving chip IC and a second edge E2 away from the driving chip IC. Taking FIG. 1 as an example, a lower edge of the hollow area TH is the first edge E1 and an upper edge of the hollow area TH is the second edge E2. In order to increase the screen occupancy ratio of the display panel, the hollow area TH is provided in the display panel to arrange other components of the display device, such as a camera, an earpiece, a light sensor and the like. It should be noted that the hollow area TH of the present disclosure may also be a non-display area after removing a part of the display panel or may also be a transparent non-display area without removing any part of the display panel.

Figure 2:
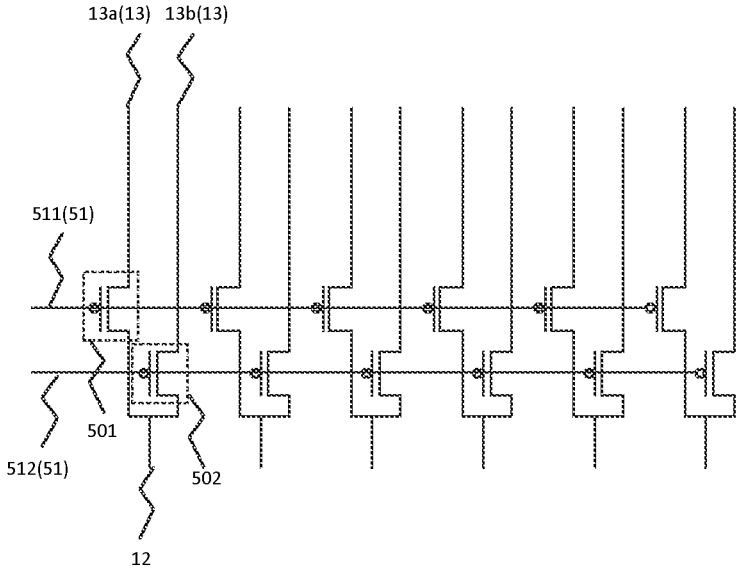
FIG. 2 is a schematic diagram of a switching circuit in an embodiment of the present disclosure.

When the display panel is provided with the hollow area TH, the display panel in the present disclosure is divided into four areas. With reference to FIG. 1, the display panel includes a first display area AA1 extending from the first side S1 of the display area AA to the second side S2 of the display area AA; a second display area AA2 extending from the first side S1 of the display area to the second edge E2 of the hollow area TH; a third display area AA3 extending from the second edge E2 of the hollow area TH to the second side S2 of the display area; and a fourth display area AA4 extending from the first edge E1 of the hollow area TH to the first side S1 of the display area. The first display area AA1 is provided with first data lines 11, the second display area AA2 is provided with second data lines 12, the third display area AA3 is provided with third data lines 13, and the fourth display area AA4 is provided with fourth data lines 14. Here, the first data lines 11, the second data lines 12, the third data lines 13, and the fourth data lines 14 are all for transmitting data signals. Since the data signals are provided by the driving chip IC, the data lines normally extends from the first side S1 of the display area AA to the second side S2 of the display area AA, just like the first data line 11 does. However, due to the presence of the hollow area TH, the fourth data lines in the fourth display area AA4 cannot extend to the corresponding third display area AA3. If the third display area AA3 needs to be provided with a data signal, the data line must be arranged along an edge of the hollow area TH, which will result in an increase in an edge border of the hollow area, thereby reducing the screen occupancy ratio and affecting the visual effect. In the present disclosure, each second data line 12 in the second display area AA4 is connected to at least two third data lines 13 via a signal switching circuit 30. The signal switching circuit 30 can transmit the signal on the second data line 12 to the third data line 13 in a time division manner. FIG. 2 is a schematic diagram of a switching circuit in an embodiment of the present disclosure. With reference to FIG. 2, each second data line 12 is connected to n third data lines 13 via a set of signal switching circuits 30. The signal switching circuits include n transistors and n control signal lines 51. Here, n is an integer larger than or equal to 2. Each transistor has a first terminal connected to the second data line 12, a second terminal connected to the third data line 13, and a control terminal connected to the control signal line 51. As shown in FIG. 2, n=2, and each second data line 12 is connected to two third data lines 13. The signal switching circuit 30 includes two transistors, which are a first transistor 501 and a second transistor 502, respectively. The first terminal of the first transistor 501 and the first terminal of the second transistor 502 are connected to the second data line 12. The gate of the first transistor 501 is connected to a first control signal line 511 and the second terminal of the first transistor 501 is connected to a third data line 13*a* in a first group of third data lines. The gate of the second transistor 502 is connected to the second control signal line 512 and the second terminal of the second transistor is connected to a third data line 13*b* in a second group of third data lines. Here, the third data line in the first group of third data lines may be an odd-numbered third data line, and the third data line in the second group of third data lines may be an even-numbered third data line. The signal switching circuit 30 receives a signal from the first control signal line 511 and a signal from the second control signal line 512 in a time division manner, so that the signal on the second data line 12 can be transmitted to the third data lines 13 in a time division manner. For example, the hollow area TH cuts off 40 columns of pixels, and the signal switching circuit 30 is a signal switching circuit with a ratio of 1:2. In this case, the fourth display area is provided with 40 columns of pixels, the second display area is provided with 40 columns of pixels, and the third display area is provided with 80 columns of pixels. That is, the second display area and the fourth display area each include 40 data lines and the third display area includes 80 data lines. Each data line in the second display area is connected to two third data lines via a signal switching circuit 30. The odd-numbered third data line 13 is connected to the first transistor 501, and the even-numbered third data line 13 is connected to the second transistor 502. When the signal on the first control signal line 511 is at an effective level, the signal on the second control signal line 512 is at a cut-off level, and the second data line 12 provides a data signal to the odd-numbered third data line 13. When the signal on the second controlling signal 512 is at an effective level, the signal on the first control signal line 511 is at a cut-off level, and the second data line 12 provides a data signal to the even-numbered third data line 13. In this way, the second data line 12 can provide the data signals to the third data lines 13 in a time division manner via the signal switching circuit, thereby avoiding winding of data line and thus reducing a border width of the hollow area TH.

Further, the first data line 11 in the first display area AA1 extends from the first side S1 to the second side S2 of the display area AA, the second data line 12 in the second display area AA2 is connected to the third data line 13 in the third display area AA3, but the fourth data line 14 in the fourth display area AA4 extends only from the first side S1 of the display area to the first edge E1 of the hollow area TH. Therefore, a length of the fourth data line 14 and a number of the pixels connected thereto are much smaller than those of other data lines, which causes its parasitic capacitance to be different from other data lines, thereby resulting in display evenness. In this embodiment, a compensation capacitor 40 connected to the fourth data line 14 is further provided, and the compensation capacitor has a capacitance of C1. A difference between a parasitic capacitance of the first data line 11 and a parasitic capacitance of the second data line is C2. Here, $0.8*C2 \leq C1 \leq 1.2*C2$. In this embodiment, the difference between the capacitances of the data lines is compensated for by the compensation capacitor 40. Moreover, when the difference between capacitances of the data lines is smaller than or equal to 20%, display unevenness can be avoided within a tolerance range for charging the data lines.

A gate driving circuit needs to be provided at a side of the hollow area TH close to the second display area AA2 to form the non-display area. Further, in order to balance a width of the non-display area around the hollow area TH, with reference to FIG. 1, the compensation capacitor 40 is arranged at the first edge E1 of the hollow area TH close to the fourth display area AA4.

Figure 3:
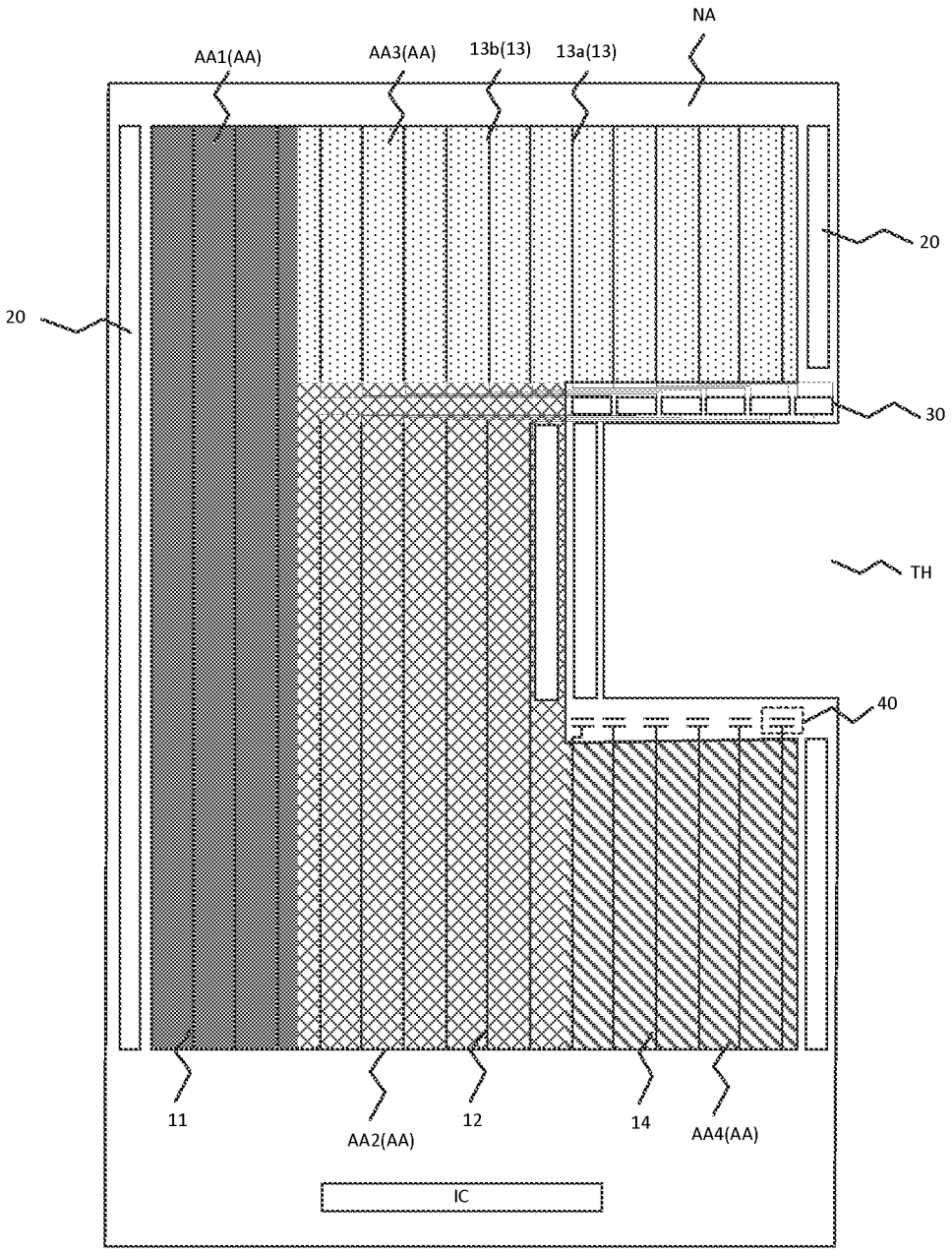
FIG. 3 is a schematic diagram of a display panel according to another embodiment of the present disclosure.

Further, the signal switching circuits 30 include a plurality of transistors. If the signal switching circuits are arranged in the display area, the display area will be occupied by the transistors of the signal switching circuits. In this case, a non-display portion will be formed in the display area, which affects the display effect. FIG. 3 is a schematic diagram of a display panel according to another embodiment of the present disclosure. In an embodiment, with reference to FIG. 3, each second data line 12 corresponds to a set of signal switching circuits 30, and the signal switching circuits 30 are arranged at the second edge E2 of the hollow area TH close to the third display area AA3. According to the technical solution of this embodiment, the signal switching circuits 30 are arranged at the second edge E2 of the hollow area TH close to the third display area AA3. In this way, on one hand, the width of the non-display border at the edge of the hollow area TH can be balanced, thereby balancing the visual effect, and on the other hand, it is not necessary to arrange the signal switching circuits 30 in the display area, thereby avoiding a non-display portion being formed in the display area.

In another embodiment of the present disclosure, each second data line 12 corresponds to a set of signal switching circuits 30, and the signal switching circuits 30 are arranged between the third data lines 13 connected thereto.

Figure 5:
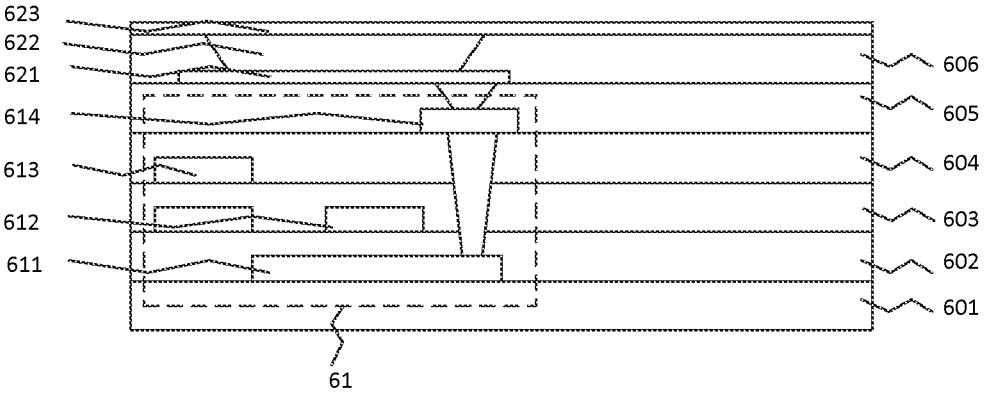
FIG. 5 is a schematic cross-sectional view of a display panel taken along line AA' of FIG. 4B according to an embodiment of the present disclosure.
Figure 6:
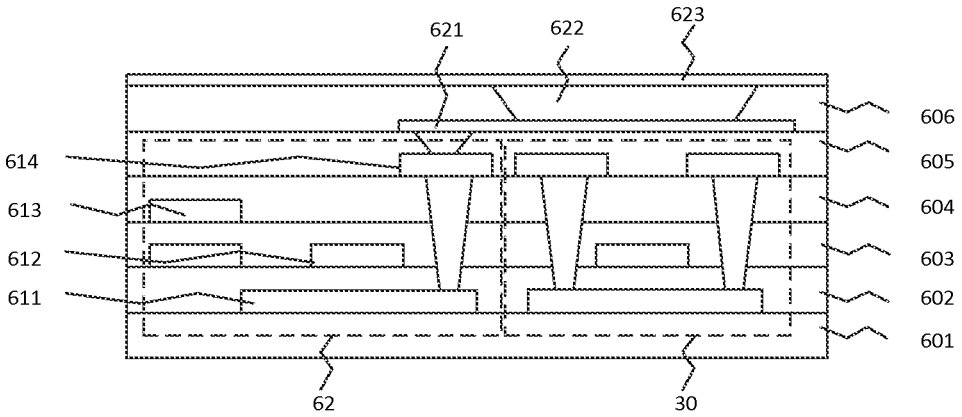
FIG. 6 is a schematic cross-sectional view of a display panel taken along line BB' of FIG. 4B according to another embodiment of the present disclosure.

FIG. 5 is a schematic cross-sectional view of a display panel according to an embodiment of the present disclosure, and FIG. 6 is a schematic cross-sectional view of a display panel according to another embodiment of the present disclosure. With reference to FIG. 5 and FIG. 6, a film layer stacking structure of the display panel of the present disclosure will be described in the following.

The display panel of the present disclosure includes a plurality of pixels and a pixel driving circuit 61 connected to each of the plurality of pixels. Each pixel includes an anode 621, a cathode 623, and a light-emitting material layer 622 arranged between the anode 621 and the cathode 623. Each driving circuit 61 is connected to the corresponding anode 621. The driving circuit 61 is formed by a transistor and a capacitor. The display panel includes a semiconductor layer 611, a gate insulation layer 602, a gate metal layer 612, a first interlayer insulation layer 603, a capacitive metal layer 613, a second interlayer insulation layer 604, a source-drain metal layer 614, a planarization layer 605, the anode 621, a pixel definition layer 606, the light-emitting material layer 622, and the cathode 623 that are sequentially disposed on the substrate 601.

Figure 4A:
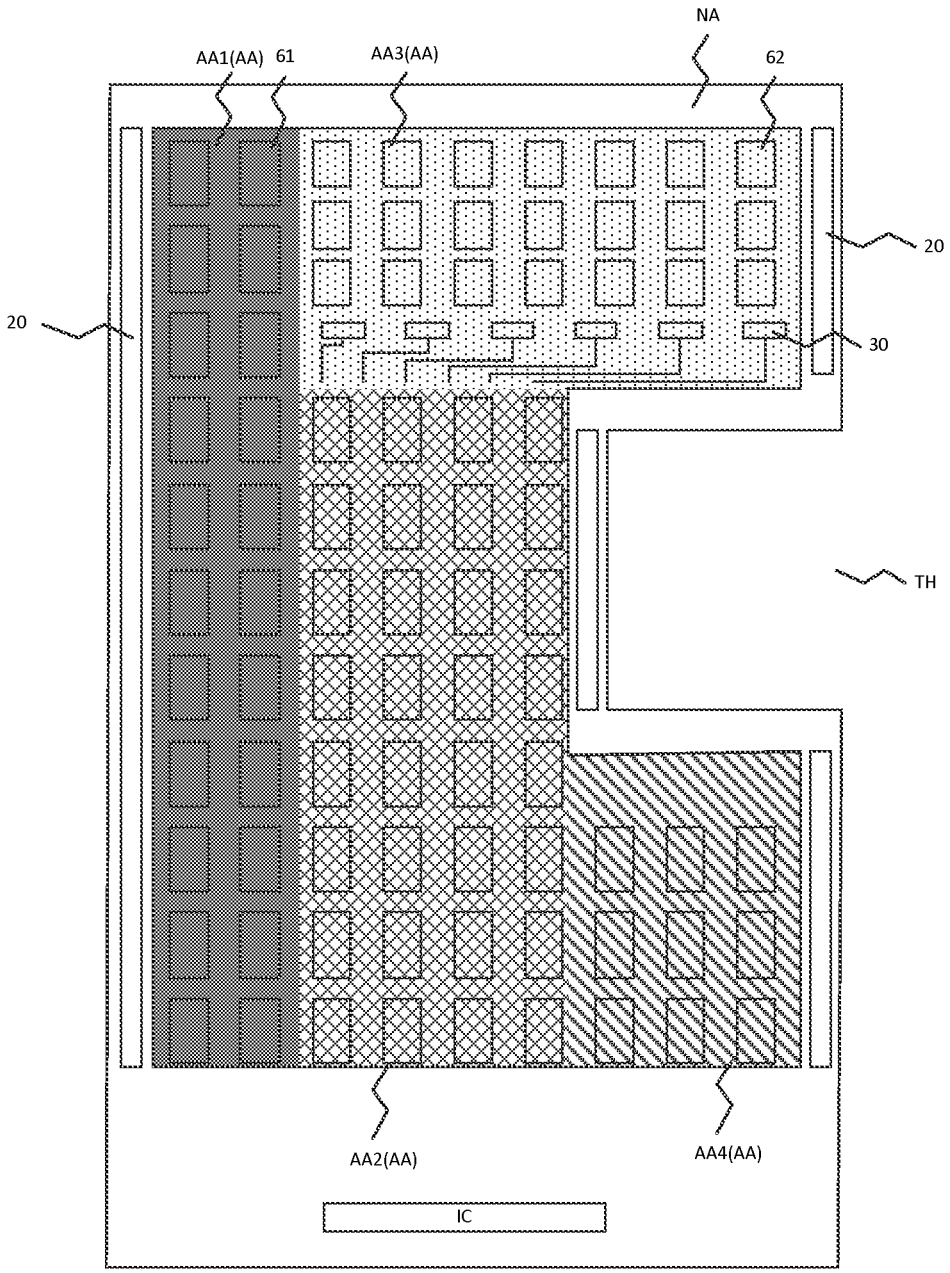
FIG. 4A is a schematic diagram of a display panel according to still another embodiment of the present disclosure.
Figure 4B:
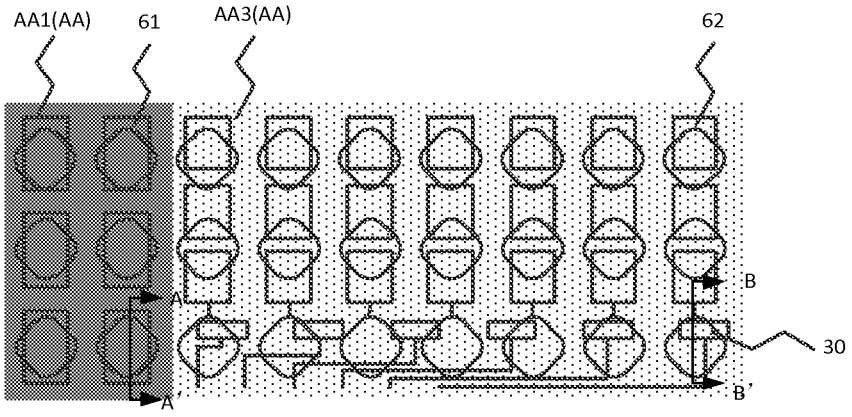
FIG. 4B is an enlarged view of a part of the display panel shown in FIG. 4A.

FIG. 4A is a schematic diagram of a display panel according to still another embodiment of the present disclosure, and FIG. 4B is an enlarged view of a part of the display panel shown in FIG. 4A.

With reference to FIG. 4A and FIG. 4B, since the signal switching circuit 30 and/or the connection line connecting the signal switching circuit 30 need to be arranged in the third display area AA3, a distance between the driving circuits 61 located in the third display area AA3 will be increased, so that the pixel density will be reduced. In order to avoid display abnormality caused by the reduction in pixel density in the third display area AA3, a size of the driving circuit 61 located in the third display area AA3 is reduced in this embodiment, so that the spare space can be used for providing the signal switching circuit 30 and/or the connection line connecting the signal switching circuit 30. The pixel driving circuit 61 located in the third display area AA3 has a size in the direction of the data line that is smaller than a size of the pixel driving circuit 61 located in the first display area AA1 in the direction of the data line. For example, the driving circuit 61 is substantially rectangular, and a width and/or a length of the driving circuit 61 located in the third display area is smaller than a width and/or a length of the driving circuit 61 located in the first display area.

Further, with the signal switching circuit 30, positions of the driving circuits 61 located in the third display area AA3 do not correspond to positions of the driving circuits 61 located in the first display area AA1. According to a conventional design, the position where the anode of the pixel is arranged with respect to the corresponding driving circuit is shown in FIG. 4, and a display function will not be achieved in an area where the signal switching circuit 30 is arranged. With reference to FIG. 4B, in the present disclosure, the pixels located in the third display area AA3 are aligned with the pixels located in the first display area AA1, so that the display area is continuous. With reference to FIG.

6, the anode 621 covers at least a portion of the signal switching circuit 30. In this way, the reduction in pixel density caused by the signal switching circuit 30 is avoided. The anode 621 is electrically connected to the corresponding driving circuit 61 through the connection line. It should be noted that the pixel alignment here means that the light-emitting areas of the pixels are aligned and arranged in a regular array.

In the present disclosure, the hollow area TH may be located at an edge of the display area or in a middle area of the display area.

Figure 7:
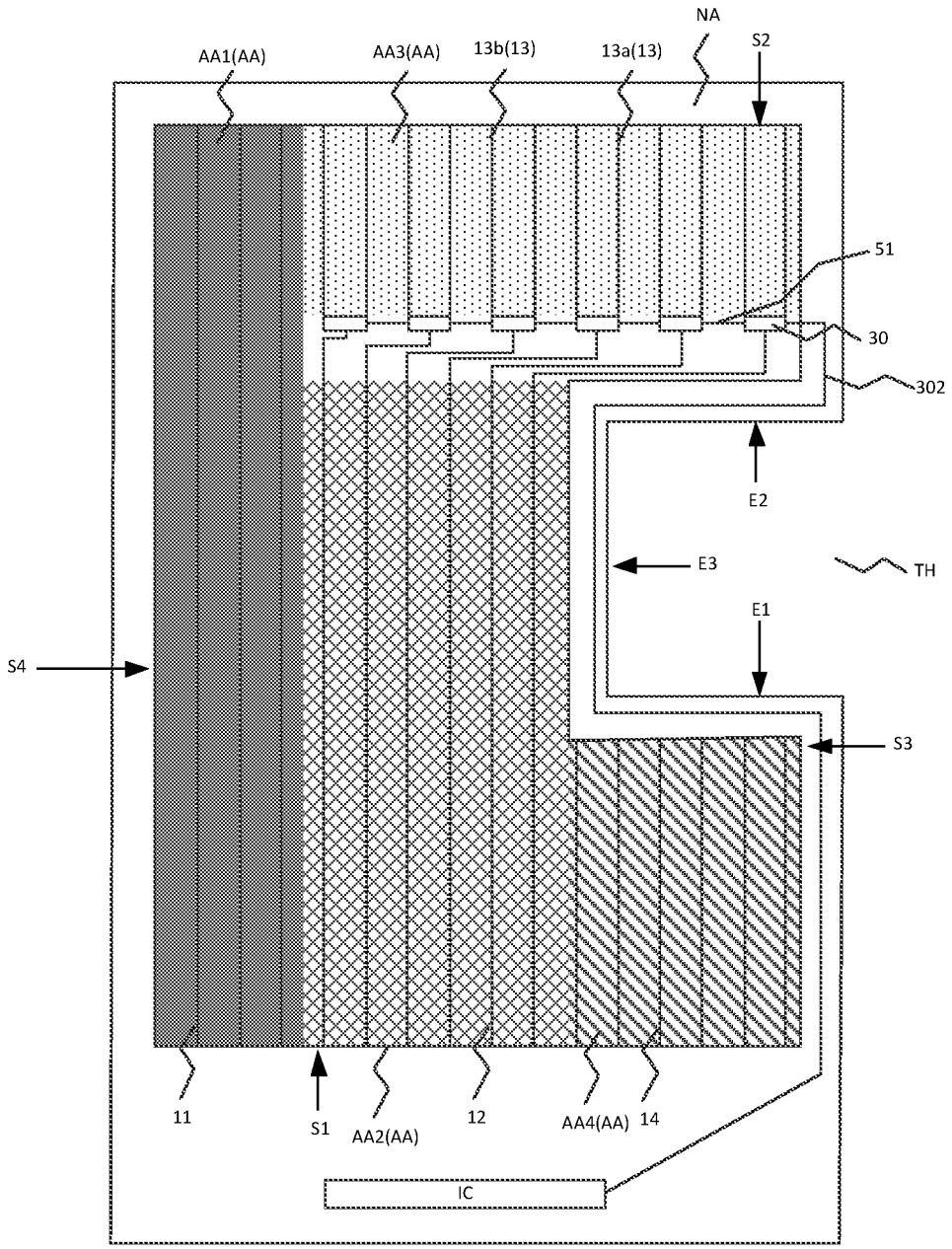
FIG. 7 is a schematic diagram of a display panel according to yet another embodiment of the present disclosure.

FIG. 7 is a schematic diagram of a display panel according to yet another embodiment of the present disclosure. With reference to FIG. 7, in an embodiment, the hollow area TH is located at the edge of the display area AA. The display area AA has a third side S3 adjacent to the first side S1 and the second side S2, and a fourth side S4 opposite to the third side S3. The hollow area is arranged at the third side S3 and forms notch area. Taking FIG. 7 as an example, a lower side of the display area AA is the first side S1, an upper side of the display area AA is the second side S2, a right side of the display area AA is the third side S3, and a left side of the display area AA is the fourth side S4. The hollow area TH is located at the third side S3 of the display area and forms a notch at the third side S3 of the display area. In this case, the third display area AA3 is adjacent to the third side S3, and the third display area AA3 is spaced from the fourth side S4 by the first display area AA1. Therefore, in this embodiment, the control signal line 51 extends towards the third side S3, and then extends to the driving chip IC through a first extension line 302 located in the non-display area close to the third side S3. In this way, it is possible to avoid the control signal line 51 passing through the first display area AA1, which may cause difficulty in wiring in the first display area.

Figure 8:
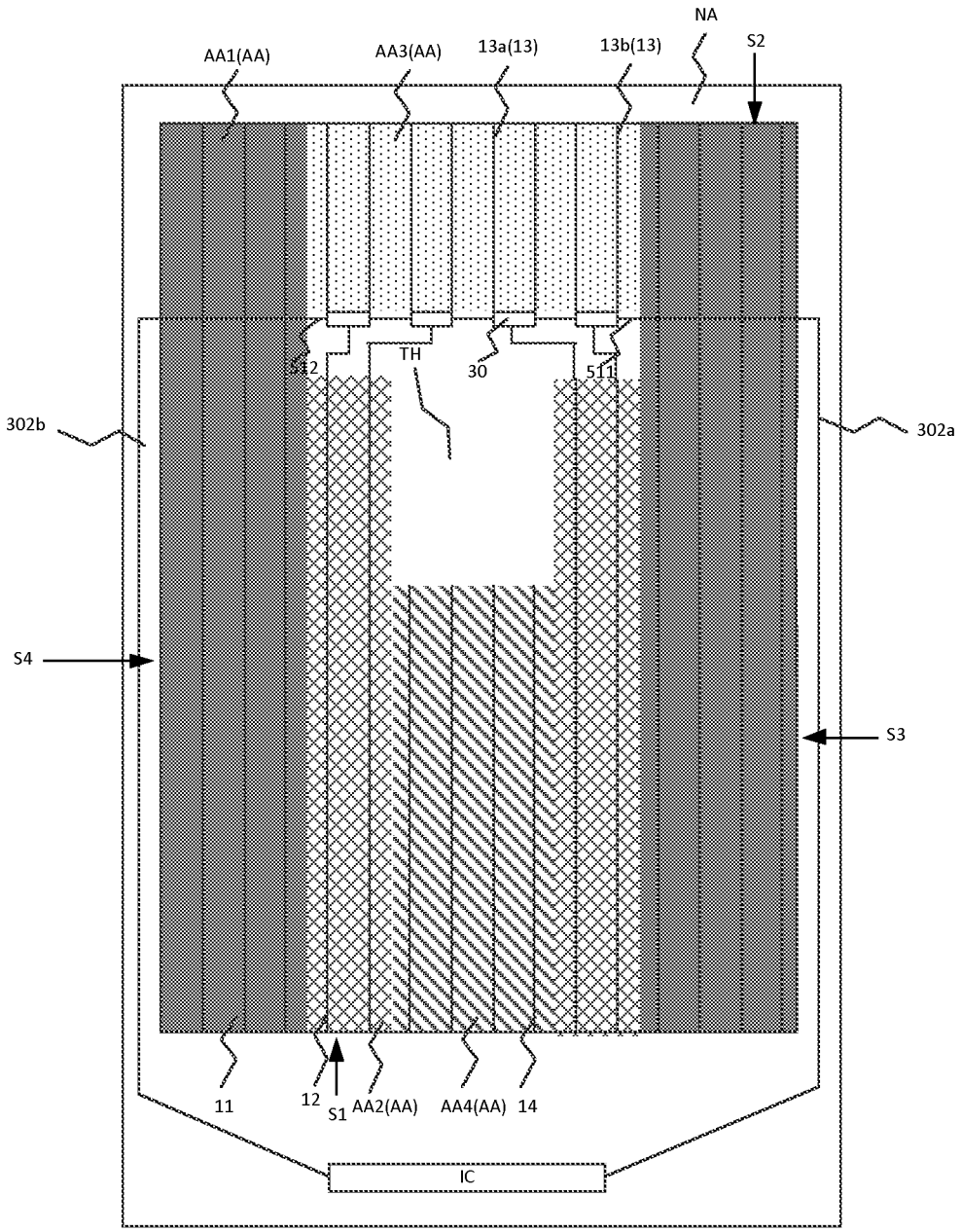
FIG. 8 is a schematic diagram of a display panel according to yet another embodiment of the present disclosure.

FIG. 8 is a schematic diagram of a display panel according to yet another embodiment of the present disclosure.

With reference to FIG. 8, in an embodiment, the hollow area TH is located in a middle area of the display area AA. The display area has a third side S3 adjacent to the first side S1 and the second side S2, and a fourth side S4 opposite to the third side S3. The hollow area TH is arranged in the middle area of the display area and forms a non-display hole. Taking FIG. 8 as an example, a lower side of the display area AA is the first side S1, an upper side of the display area AA is the second side S2, a right side of the display area AA is the third side S3, and a left side of the display area AA is the fourth side S4. In this case, the third display area AA3 is spaced from the third side S3 by the first display area AA1, and the third display area AA3 is spaced from the fourth side S4 by the first display area AA1. If the control signal line 51 extends to the driving chip only from the third side S3 or only from the fourth side S4, an extension line of the control signal line 51 will be only arranged in the first display area located at one of the left and right sides, and will not be arranged in the first display area located at the other one of the left and right sides. In this case, the first display area is asymmetrical between the left side and the right side, thereby increasing layout difficulty. In this embodiment, the control signal line 51 includes a first control signal line 511 extending towards the third side S3 and a second control signal line 512 extending towards the fourth side S4. The first control signal line 511 extends to the driving chip through a first extension line 302*a* located in the non-display area close to the third side S3. The second control signal line 512 extends to the driving chip IC through a first extension line 302*b* located in the non-display area close to the fourth side S4.

Figure 9:
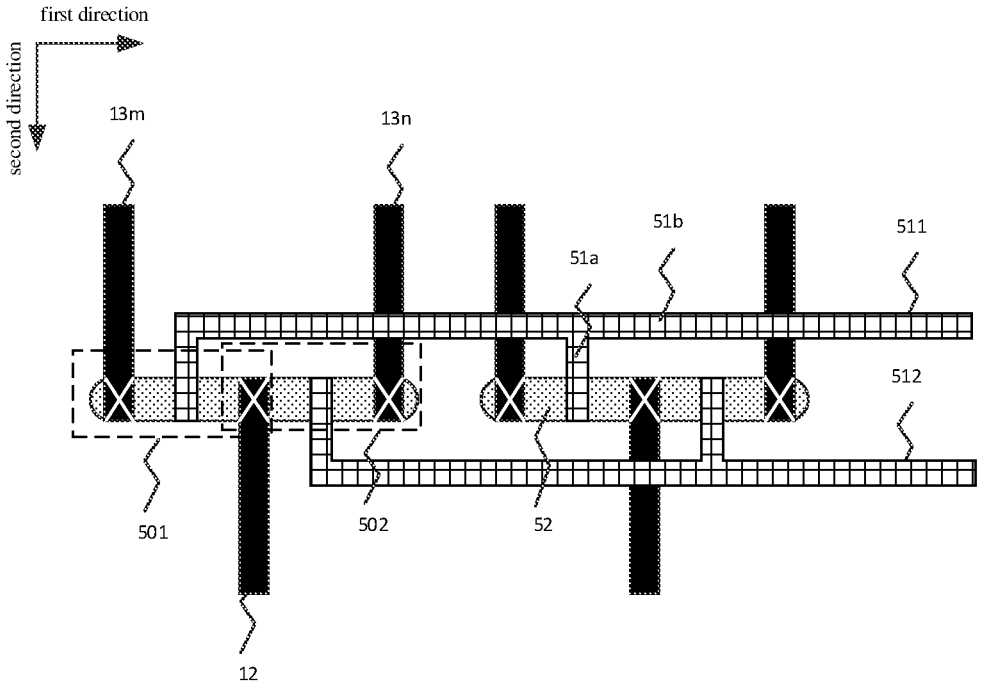
FIG. 9 is a schematic diagram of a switching circuit in another embodiment of the present disclosure.

FIG. 9 is a schematic diagram of a switching circuit in another embodiment of the present disclosure. Refer to FIG. 2 and FIG. 9, where FIG. 9 is a schematic layout diagram of the signal switching circuit in the embodiment shown in FIG. 2. The set of signal switching circuits 30 includes a first transistor 501 and a second transistor 502. The first electrode of the first transistor 501 and the first electrode of the second transistor are both connected to one second data line 12. The first transistor 501 has a second electrode connected to a third data line 13*a* in a first group of third data lines. The second transistor 502 has a second electrode connected to a third data line 13*b* in a second group of third data lines adjacent to the third data line 13*a*. The first transistor 501 has a gate connected to the first control signal line 511. The second transistor 502 has a gate connected to the second control signal line 512. The signal switching circuit 30 is arranged between the driving circuits located in the third display area and located in the second display area, and the positions of the anodes of the pixels located in the third display area are aligned with the positions of the anodes of the pixels located in the first display area. Therefore, the larger the distance between the driving circuits located in the third display area and located in the second display area is, the longer the connection line between the pixels located in the third display area and the anodes corresponding thereto will be, the more difficult the layout will be, and the worse the display evenness will be. In order to minimize the distance between the driving circuits located in the third display area and located in the second display area, in this embodiment, the set of signal switching circuits includes a linear active layer 52 extending in the first direction. The active layer has a first end and a second end connected to the third data line 13*a* in the first group of third data lines and the third data line 13*b* in the second group of third data lines, respectively. A middle area of the active layer 52 is connected to the second data line 12. The first control signal line 511 and the second control signal line 512 each include a gate portion 51*a* extending in the second direction and a body portion 51*b*. The body portion 51*b* does not overlap the active layer 52, and the gate portion 51*a* overlaps the active layer 52. The second direction intersects the first direction. Optionally, the first direction is perpendicular to the second direction.

Figure 10:
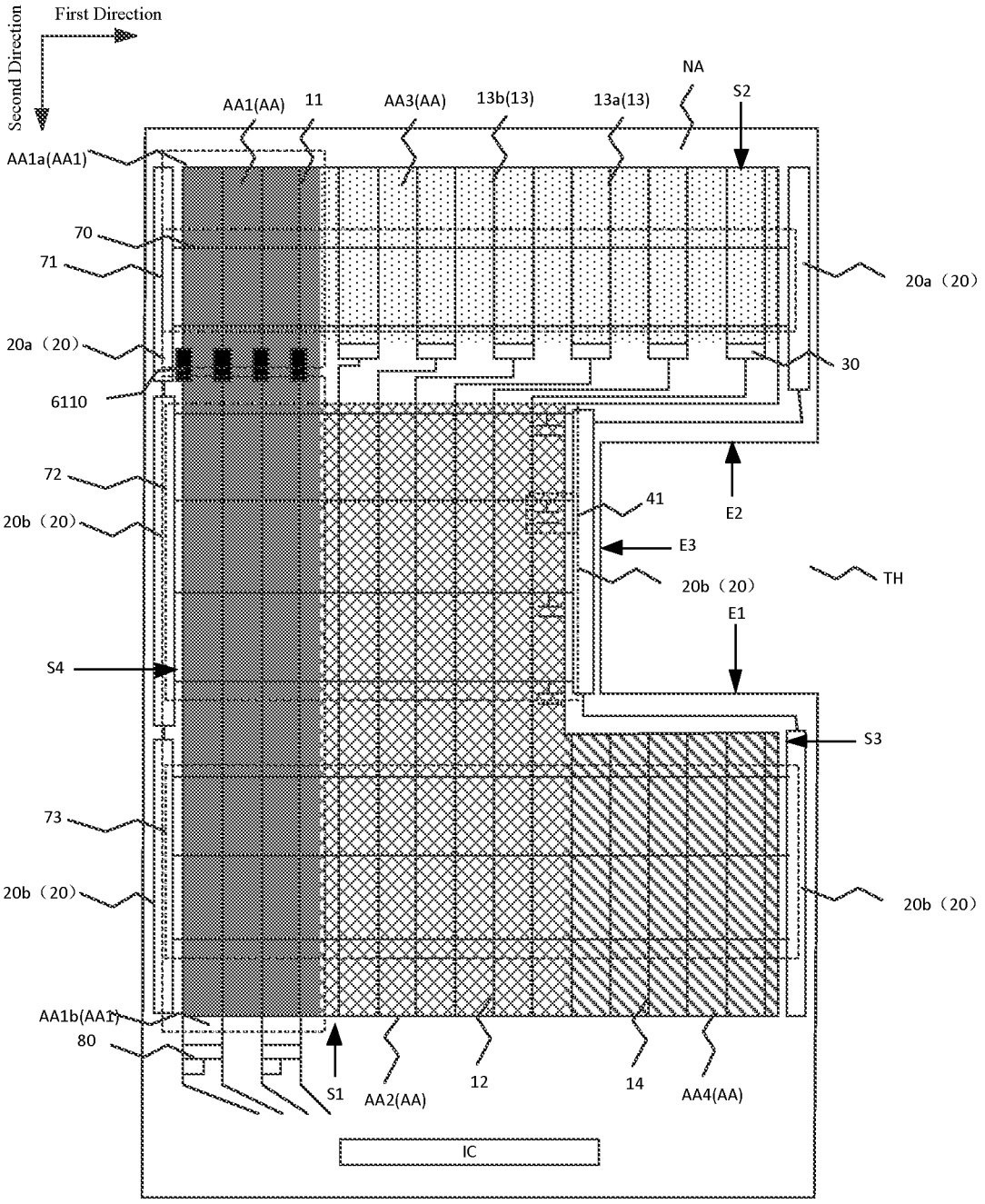
FIG. 10 is a schematic diagram of a display panel according to yet another embodiment of the present disclosure.

FIG. 10 is a schematic diagram of a display panel according to yet another embodiment of the present disclosure. With reference to FIG. 10, a method for driving a display panel is described as follows in conjunction with the accompanying drawings.

In an embodiment, the display panel includes scan lines 70 extending in the first direction and arranged in the second direction, and data lines extending in the second direction and arranged in the first direction. The data lines include a first data line 11, a second data line 12, a third data line 13, and a fourth data line 14. The display area AA has a third side S3 adjacent to the first side S1 and the second side S2, and a fourth side S4 opposite to the third side S3. The hollow area TH is arranged at the third side S3 and forms a notch area. The notch area has a third edge E3 adjacent to both the first edge E1 and the second edge E2. In the embodiment as shown in FIG. 10, the first side S1 is the lower side of the display area, the second side S2 is the upper side of the display area, the third side S3 is the right side of the display area, and the fourth side S4 is the left side of the display area. The first edge E1 is the lower edge of the hollow area TH, the second edge E2 is the upper edge of the hollow area TH, and the third edge E3 is the left edge of the hollow area TH.

In the first direction, the first display area AA1 is close to the fourth side S4 of the display area, the second display area AA2 is disposed between the first display area AA1 and the third edge E3 of the notch area TH, the third display area AA3 is disposed between the first display area AA1 and the third side S3 of the display area, and the fourth display area AA4 is disposed between the third edge E3 of the notch area TH and the third side S3 of the display area. The first display area AA1 includes a first portion AA1*a* aligned with the third display area AA3 in the first direction, and a second portion AA1*b* aligned with the second display area AA2 in the first direction. Since at least two third data lines 13 located in the third display area AA3 share one second data line 12 through the signal switching circuit 30 for transmitting the data signal, the data lines located in the third display area AA3 should be provided with data signals in a time division manner. However, the other display areas than the third display area do not need to be provided with data signals in a time division manner. Therefore, there is a difference in driving time. In particular, the data signal is written when the scan line 70 provides an effective level. However, the effective level provided by one scan line in the third display area AA3 needs to allow at least two data signals to be written in a time division manner. Therefore, the effective level of the scan signal required in the third display area AA3 needs to have a width that is at least twice the width of the effective level of the scan signal in the other display areas. If the entire display area uses the effective level with such a width, the time for scanning the entire display panel will be doubled, which will reduce the number of frames for the display panel. Taking the display panel with a 1920*1080 resolution at 60 frames per second as an example, each frame is 16.7 ms, and the time (the width of the effective level) for scanning each row is shorter than or equal to 16.7 ms/1920≈8.7 μs. On one hand, in the third display area AA3, the data signal needs to be written into two third data lines 13 in a time division manner during the time for scanning one row; and on the other hand, it takes a minimum time, for example 5 μs, to allow the data signal to be sufficiently written. Therefore, in this case, the time for scanning each row in the third display area AA3 must be longer than or equal to 10 μs. If each row is scanned according to this time, an overall frame rate for the display penal will be 1 s/(10 μs*1920)=52 frames, which is significantly lower than 60 frames and therefore will affect an image quality of the display panel.

Accordingly, an embodiment of the present disclosure provides a driving method. In a first period T1, the first portion AA1*a* of the first display area AA1 and the third display area AA3 are simultaneously driven; and in a second period T2, the second portion AA1*b* of the first display area AA1 and the second display area AA2 are simultaneously driven. Moreover, the fourth display area AA4 is driven simultaneously with the second portion AA1*b* of the first display area AA1 and the second display area AA2 during at least a portion of the second period T2. Taking the display panel with a 1920*1080 resolution as an example, if the third display area has x rows, the second display area will have (1920−x) rows. The time for scanning each of the x rows is 10 μs, and the time for scanning each of the (1920−x) rows is 5 μs. Then the total time of scanning one frame is 10x+1920*5−5x=5*(1920+x) μs. If the frame rate for the display panel is higher than 60 frames, it is required to satisfy 5*(1920+x) μs≤16.7 ms, i.e., x≤1420. That is, taking the display panel with a 1920*1080 resolution as an example, if it requires to maintain 60 frames, according to the driving method in this embodiment, the number of rows in the third display area AA3 needs to be smaller than 1420. In other words, according to the driving method in this embodiment, the display panel of the present disclosure can achieve driving at a high frame rate. In addition, the pixels located in one row are driven at the same time, so as to achieve the shortest total driving time for one frame. In this embodiment, each scan line 70 simultaneously drives a row of pixels, and the pixels located in the first portion AA1*a* of the first display area AA1 and the pixels located in the third display area AA3 are connected to one set of scan lines. Therefore, in this embodiment, the first display area AA1 is divided into the first portion AA1*a* and the second portion AA1*b*, and the first portion AA1*a* of the first display area and the third display area AA3 are simultaneously driven. Similarly, the fourth display area, a portion of the first display area, and the second display area are connected to one set of scan lines. Therefore, the fourth display area AA4 is driven simultaneously with the second portion AA1*b* of the first display area AA1 and the second display area AA2 during at least a portion of the second period T2.

Referring to FIG. 10 again, the scan lines 70 include a first set of scan lines 71, a second set of scan lines 72, and a third set of scan lines 73. The first set of scan lines 71 are arranged close to the first portion AA1*a* of the first display area AA1 and the third display area AA3. The second set of scan lines 72 are arranged close to the second portion AA1*b* of the first display area AA1 and a portion of the second display area AA2 corresponding to the notch area TH. The third set of scan lines 73 are arranged close to the fourth display area AA4, the second portion AA1*b* of the first display area AA1, and a portion of the second display area AA2 corresponding to the fourth display area AA4. The number of pixels connected to the second set of scan lines 72 is smaller than the number of pixels connected to the first set of scan lines 71. The number of pixels connected to the second set of scan lines 72 is smaller than the number of the pixels connected to the third set of scan lines 73. Thus, there is a difference between loads on the scan lines 70, which will affect an effective width of the scan line, as well as a voltage level of the effective level, thereby affecting writing of the data signals, or causing technical problems such as color deviation and inadequate dark state. Therefore, in this embodiment, the second set of scan lines 72 is connected to a load compensation unit 41.

Further, on one hand, the third data line 13 located in the third display area is connected to the second data line 12 located in the second display area through the signal switching circuit 30, and the data signal has a voltage drop after passing through the signal switching circuit 30. On the other hand, the first data line 11 has no voltage drop between the second portion AA1*b* of the first display area AA1 and the first portion AA1*a* of the first display area AA1. Therefore, the same data signal has different voltage drops when being transmitted to the first portion AA1*a* of the first display area AA1 and to the third display area AA3, and thus the resulting driving currents are different. In order to solve this problem, in this embodiment, in the first display area AA1, the data lines located in the first portion AA1*a* are connected to the data lines located in the second portion AA1*b* in a one-to-one correspondence by an active layer resistance line 6110. The active layer resistance line herein refers to a resistance unit arranged in the same layer as the active layer. Moreover, a resistance value of the active layer resistance line 6110 can be set based on an equivalent resistance of the signal switching circuit 30, so as to avoid display abnormality caused by different voltage drops.

Figure 11:
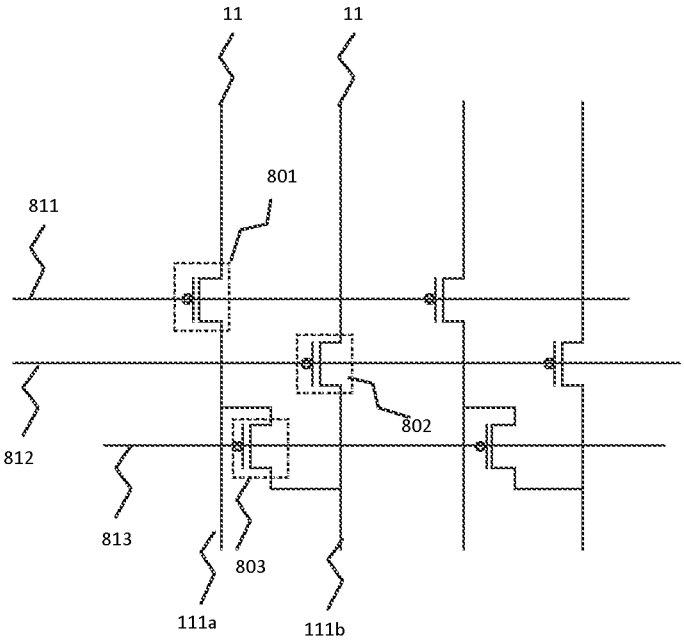
FIG. 11 is a schematic enlarged view of a multiplexer of the display panel shown in FIG. 10.
Figure 12:
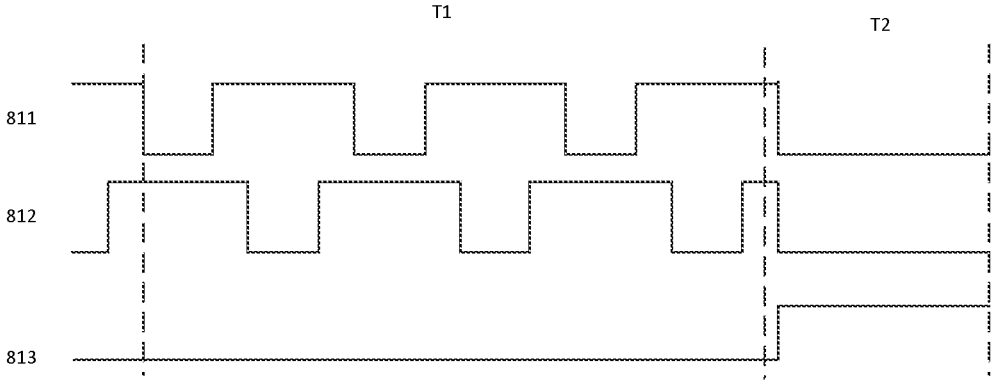
FIG. 12 is a timing sequence diagram of the multiplexer of the display panel shown in FIG. 11.

FIG. 10 is a schematic diagram of a display panel according to yet another embodiment of the present disclosure. FIG. 11 is a schematic enlarged view of a multiplexer of the display panel shown in FIG. 10. FIG. 12 is a timing sequence diagram of the multiplexer of the display panel shown in FIG. 11.

With reference to FIGS. 10-12, in an embodiment, the first portion AA1*a* of the first display area AA1 and the third display area AA3 are simultaneously driven, but the third data line 13 located in the third display area AA3 receives a data signal in a time division manner while the first data line 11 located in the first display area AA1 does not receive a data signal in a time division manner. Thus, during an effective level phase of the signal for scanning one row, the first data line 11 is always being charged while the third data line 13 is being charged only for half time of this phase. With the same data voltage and different charging time periods, the resulting driving currents will also be different. In this case, a display difference between the first portion AA1*a* of the first display area AA1 and the third display area AA3 will occur, and a clear boundary may even be formed. Therefore, in this embodiment, a first non-display area is arranged at a side of the first display area AA1 close to the driving chip IC, and the first non-display area is provided with a multiplexing circuit 80. In the first period T1, the multiplexing circuit 80 is turned on; and in the second period T2, the multiplexing circuit 80 is turned off. Thus, in the first period T1, the first data line 11 receives a data signal in a time division manner as well, and the charging time thereof is the same as the charging time of the third data lines 13, thereby avoiding the display difference between the first portion AA1*a* of the first display area AA1 and the third display area AA3.

In an embodiment of the present disclosure, an equivalent circuit diagram of the multiplexer 80 is illustrated in FIG. 11. The multiplexer 80 includes a first switching transistor 801, a second switching transistor 802, and a third switching transistor 803. The first switching transistor 801 has a gate connected to a first switching control signal 811, a first electrode connected to a fanout line 111*a*, and a second electrode connected to a first data line 11. The second switching transistor 802 has a gate connected to a first switching control signal 812, a first electrode connected to a fanout line 111*b*, and a second electrode connected to another first data line 11. The third switching transistor 803 has a gate connected to a third switching control signal 813, a first electrode connected to the first electrode of the first switching transistor 801, and a second electrode connected to the first electrode of the second switching transistor 802. FIG. 12 illustrates a timing sequence diagram of the multiplexer 80. In the first period T1, the first switching control signal 811 and the second switching control signal 812 alternately output an effective level, and the third switching control signal 813 continuously outputs an effective level. At this time, the fanout line 111*a* or 111*b* outputs a data signal to the first data line 11 in a time division manner. In the second period T2, the first switching control signal 811 and the second switching control signal 812 continuously output an effective level, and the third switching control signal 813 continuously outputs an effective cut-off level. At this time, the fanout line 111*a* outputs a data signal to a first data line 11, and the fanout line 111*b* outputs a data signal to another first data line 11. According to the setting of the present disclosure, the charging time of the first portion of the first display area can be the same as the charging time of the third display area, and the charging time of the second portion of the first display area can be the same as the charging time of second display area are the same.

Further, since the third display area AA3 is driven in a time division manner, the scan signal for driving the third display area AA3 is different from the scan signal for driving the second display area. In an embodiment of the present disclosure, the driving circuit can be divided into two parts for providing a start signal and a clock signal, respectively, to adjust the width of the effective level of the scan signal output from the scan driving circuit. In particular, a first driving circuit 20*a* is arranged in the non-display area of the display panel and drives the first portion AA1*a* of the first display area AA1 and the third display area AA3. A second driving circuit 20*b* is arranged in the non-display area of the display panel and drives the second portion AA1*b* of the first display area AA1, the second display area AA2 and the fourth display area AA4. The first driving circuit 20*a* is provided with a first start signal and a first clock signal. The second driving circuit 20*b* is provided with a second start signal and a second clock signal. In the first period T1, the first start signal and the first clock signal are provided, and the first driving circuit 20*a* performs driving row by row. In the second period T2, the second start signal and the second clock signal are provided, and the second driving circuit 20*b* performs driving row by row.

Further, a width of an effective level of the first start signal is larger than a width of an effective level of the second start signal. A cycle of the first clock signal is equal to twice a cycle of the second clock signal. This embodiment is applicable to the signal switching circuit with a ratio of 1:2, in which case the width of the effective level of the scan signal outputted from the first driving circuit 20*a* can be twice the width of the effective level of the scan signal outputted from the second driving circuit 20*b*.

Figure 13:
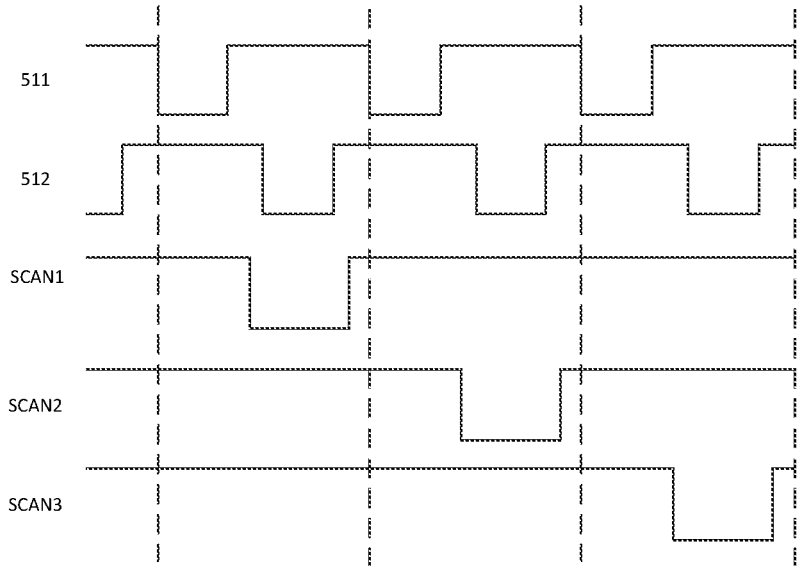
FIG. 13 is a timing sequence diagram of a display panel according to an embodiment of the present disclosure.

FIG. 13 is a timing sequence diagram a display panel according to an embodiment of the present disclosure. Referring to FIG. 2 and FIG. 13, the set of signal switching circuits 30 include a first transistor 501 and a second transistor 502. The first electrode of the first transistor 501 and the first electrode of the second transistor 502 are both connected to one second data line 12. The first transistor 501 has a second electrode connected to a third data line 13*a* in the first group of third data lines. The second transistor 502 has a second electrode connected to a third data line 13*b* in the second group of third data lines adjacent to the third data line 13*a*. The first transistor 501 has a gate connected to the first control signal line 511. The second transistor 502 has a gate connected to the second control signal line 512.

With reference to FIG. 13, the first control signal line 511 and the second control signal line 512 alternately output an effective level. SCAN1, SCAN2, and SCAN3 shown in FIG. 13 represent scan signals for a first row, a second row, and a third row, respectively. When the first control signal line 511 or the second control signal line 512 is at an effective level, the data signal is transmitted to the data line. When the scan signal is at an effective level, the data signal is written into the driving transistor. Taking the scan signal SCAN1 for the first row as an example, if low levels of the signal SCAN1 cover the effective levels of the first control signal line 511 and the second control signal line 512, when the first control signal line 511 is at an effective level, a data signal is written into the driving transistor connected to the third data line 13*a* in the first group of third data lines, and since no data signal is written into the third data line 13*b* in the second group of third data lines, no data signal is written into the driving transistor connected to the third data line 13*b* in the second group of third data lines either. When the second control signal line 512 is at an effective level, due to a parasitic capacitance of the third data line 13*a* in the first group of third data lines, a data signal is continuously written into the driving transistor connected to the third data line 13*a* in the first group of third data lines, meanwhile a data signal is also written into the third data line 13*b* in the second group of third data lines. Therefore, it can be seen that the time during which a data signal is written into the driving transistor connected to the third data line 13*a* in the first group of third data lines is longer than the time during which a data signal is written into the driving transistor connected to the third data line 13*b* in the second group of third data lines, and thus a display abnormality may occur. However, when the effective level of the first scanning signal SCAN1 occurs after the effective level of the first control signal line 511 and the second control signal line 512, the time during which a data signal is written into the driving transistor connected to the third data line 13*a* in the first group of third data lines is the same as the time during which a data signal is written into the driving transistor connected to the third data line 13*b* in the second group of third data lines, but in this case, one scan cycle is separated from another by the effective level of the first control signal line 511 and the second control signal line 512 and the effective level of the first scan signal SCAN1. In this case, the time separation is long, and the frame rate for the display panel will be reduced.

In an embodiment of the present disclosure, an effective level of the second control signal line 512 occurs after an effective level of the first control signal line 511, the effective level of the first control signal line 511 does not overlap an effective level of the scan line, and the effective level of the scan line covers the effective level of the second control signal line 512. In this case, when the first control signal line 511 is at an effective level, a data signal is written into the third data line 13*a* in the first group of third data lines, but the signal is not written into the driving transistor, and no data signal is written into the third data line 13*b* in the second group of third data lines. When the second control signal line 512 is at an effective level, a data signal is continuously written into the driving transistor connected to the third data line 13*a* in the first group of third data lines due to the parasitic capacitance of the third data line 13*a* in the first group of third data lines, and a data signal is also written into the third data line 13*b* in the second group of third data lines. Therefore, the time during which a data signal is written into the driving transistor connected to the third data line 13*a* in the first group of third data lines is the same as the time during which a data signal is written into the driving transistor connected to the third data line 13*b* in the second group of third data lines, thereby avoiding display abnormality.

Figure 14:
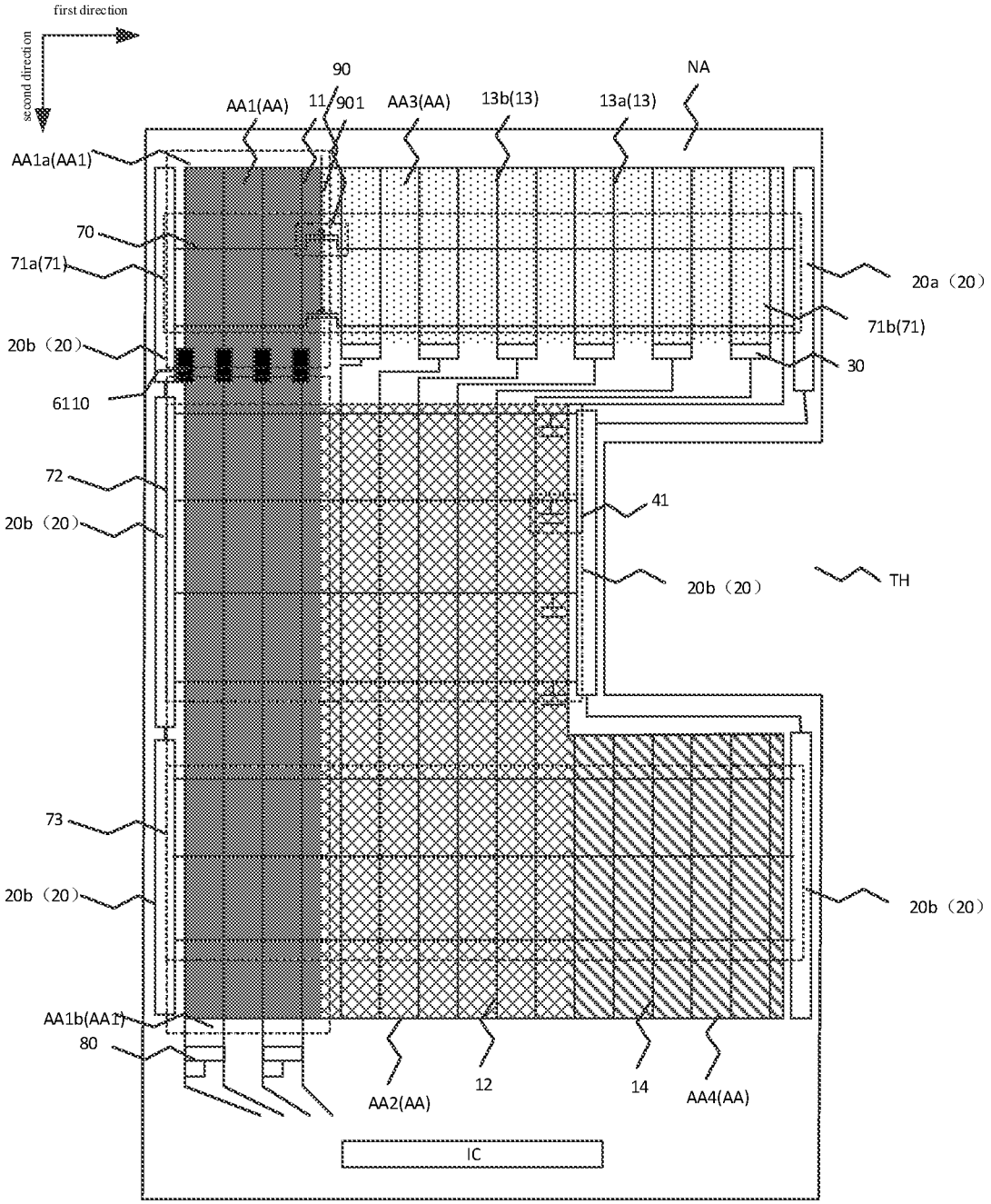
FIG. 14 is a schematic diagram of a display panel according to yet another embodiment of the present disclosure.
Figure 15:
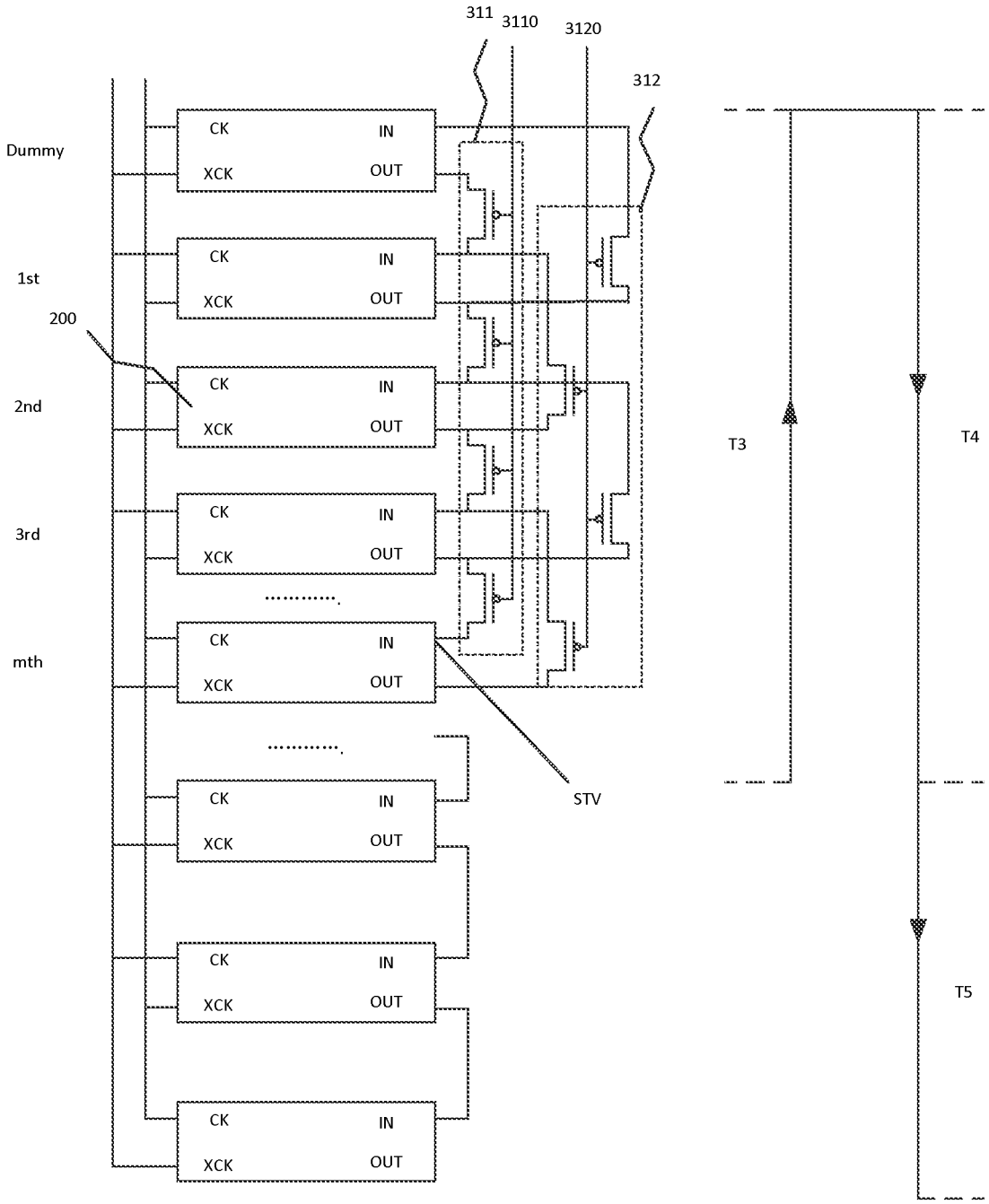
FIG. 15 is a schematic enlarged view of a part of the display panel shown in FIG. 14.
Figure 16:
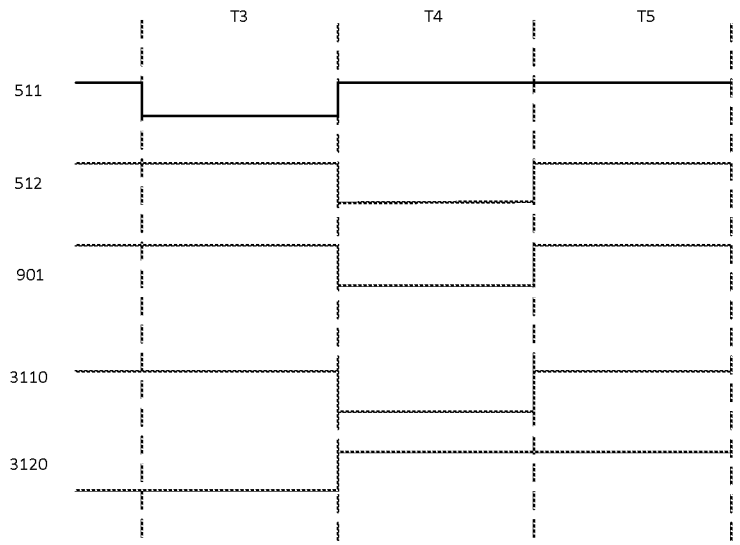
FIG. 16 is a timing sequence diagram of a display panel according to another embodiment of the present disclosure.

An embodiment of the present disclosure further provides another driving method. Please refer to FIGS. 14-16, where FIG. 14 is a schematic diagram of a display panel according to yet another embodiment of the present disclosure, FIG. 15 is a schematic enlarged view of a part of the display panel shown in FIG. 14, and FIG. 16 is a timing sequence diagram of a display panel according to another embodiment of the present disclosure.

In an embodiment, the display panel includes scan lines 70 extending in the first direction and arranged in the second direction, and data lines extending in the second direction and arranged in the first direction. The data lines include a first data line 11, a second data line 12, a third data line 13, and a fourth data line 14. The display area AA has a third side S3 adjacent to the first side S1 and the second side S2, and a fourth side S4 opposite to the third side S3. The hollow area TH is arranged at the third side S3 and forms a notch area. The notch area has a third edge E3 adjacent to both the first edge E1 and the second edge E2. In an embodiment as shown in FIG. 10, the first side S1 is the lower side of the display area, the second side S2 is the upper side of the display area, the third side S3 is the right side of the display area, and the fourth side S4 is the left side of the display area. The first edge E1 is the lower edge of the hollow area TH, the second edge E2 is the upper edge of the hollow area TH, and the third edge E3 is the left edge of the hollow area TH.

In the first direction, the first display area AA1 is close to the fourth side S4 of the display area, the second display area AA2 is arranged between the first display area AA1 and the third edge E3 of the notch area TH, the third display area AA3 is arranged between the first display area AA1 and the third side S3 of the display area, and the fourth display area AA4 is arranged between the third edge E3 of the notch area TH and the third side S3 of the display area. The first display area AA1 includes a first portion AA1*a* aligned with the third display area AA3 in the first direction, and a second portion AA1*b* aligned with the second display area AA2 in the first direction. Since at least two third data lines 13 located in the third display area AA3 share one second data line 12 through the signal switching circuit 30 for transmitting the data signal, the frame rate is reduced, thereby affecting an image quality of the display panel. The reason thereof has been described in details in the above embodiments, and will not be further described herein.

In this embodiment, in a third period T3, a portion of the third display area is driven; in a fourth period T4, the first portion AA1*a* of the first display area and another portion of the third display area are simultaneously driven; and in a fifth period T5, the second portion AA1*b* of the first display area and the second display area AA2 are simultaneously driven. Moreover, the fourth display area AA4 is driven simultaneously with the second portion AA1*b* of the first display area and the second display area AA2 during at least a portion of the fifth period T5. Here, a portion of the third display area may refer to an area where the pixels connected to the third data lines in the first group of third data lines are located, and another portion of the third display area may refer to an area where the pixels connected to the third data lines in the second group of third data lines are located. Alternatively, a portion of the third display area may refer to an area where the pixels connected to the third data lines in the second group of third data lines are located, and another portion of the third display area may refer to an area where the pixels connected to the third data lines in the first group of third data lines are located. The third data line in the first group of third data lines may be an odd-numbered third data line, and the third data line in the second group of third data lines may be an even-numbered third data line. Taking signal switching circuit with a ratio of 1:2 as an example, for example, the first transistor of the signal switching circuit is connected to the odd-numbered third data line, and the second transistor of the signal switching circuit is connected to the even-numbered third data line, then the pixels connected to the odd-numbered third data lines in the third display area are driven in the third period T3, and the pixels connected to the even-numbered third data lines in the third display area are driven in the fourth period T4.

On the one hand, taking the display panel with a 1920*1080 resolution as an example, if the third display area has x rows, the second display area will have (1920−x) rows. The time for scanning each of the x rows is 10 μs, and the time for scanning each of the (1920−x) rows is 5 μs. Then the total time for scanning one frame is 10x+1920*5−5x=5*(1920+x) μs. If the frame rate for the display panel is higher than 60 frames, it is required to satisfy 5*(1920+x) μs≤16.7 ms, i.e., x≤1420. That is, taking the display panel with a 1920*1080 resolution as an example, if it requires to maintain 60 frames, according to the driving method in this embodiment, the number of rows in the third display area AA3 needs be smaller than 1420. In other words, according to the driving method in this embodiment, the display panel of the present disclosure can achieve driving at a high frame rate. In addition, the pixels located in one row needs be driven at the same time, so as to achieve the shortest driving time for one frame. In this embodiment, each scan line 70 simultaneously drives a row of pixels, and the pixels located in the first portion AA1*a* of the first display area AA1 and the pixels located in the third display area AA3 are connected to one set of scan lines. Therefore, the first display area AA1 is divided into the first portion AA1*a* and the second portion AA1*b*, and the first portion AA1*a* of the first display area and the third display area AA3 are simultaneously driven. Similarly, the fourth display area, a portion of the first display area, and the second display area are connected to one set of scan lines. Therefore, the fourth display area AA4 is driven simultaneously with the second portion AA1*b* of the first display area AA1 and the second display area AA2 during at least a portion of the second period T2.

On the other hand, in this embodiment, instead of requiring the data signal to be transmitted in a time division manner during the scanning period, scanning is performed in two periods and the data signals are transmitted respectively, so that the scanning time of each stage is the same and thus it is not necessary to set different widths for the effective levels of different scanning signals based on different areas, thereby greatly reducing complexity of the IC.

Further, with reference to FIG. 14 and FIG. 15, the non-display area of the display panel is provided with a first driving circuit 20*a* for driving the first portion AA1*a* of the first display area and the third display area AA3, and a second driving circuit 20*b* for driving the second portion AA1*b* of the first display area, the second display area AA2, and the fourth display area AA4.

In the third period T3, in a direction along which the second edge E2 of the notch area TH points to the second side S2 of the display area, the first driving circuit 20*a* outputs a driving signal stage by stage. In the fourth period T4, in a direction along which the second side S2 of the display area points to the second edge E2 of the notch area TH, the first driving circuit 20*a* outputs a driving signal stage by stage. In other words, the third period T3 and the fourth period T4 share the first driving circuit 20*a*, and the time division driving can be achieved by the first driving circuit 20*a* performing reverse scanning during the third period T3 and forward scanning during the fourth period T4. In this embodiment, one driving circuit is used to achieve scanning in two periods, thereby reducing the number of driving circuits, and thus facilitating providing a display panel with a narrow border.

Further, a conventional driving circuit cannot perform forward scanning and reverse scanning at the same time. With reference to FIG. 15, in an embodiment of the present disclosure, the first driving circuit includes the $1^{st}$ stage of first driving circuit unit 200 to the $m^{th}$ stage of first driving circuit unit 200 in a direction along which the second edge E2 of the notch area TH points to the second side S2 of the display area. Each first driving circuit unit 200 has an output terminal OUT and an input terminal IN. The output terminal OUT of the $i^{th}$ stage of first driving circuit unit 200 is connected to the input terminal IN of the $(i+1)^{th}$ stage of first driving circuit unit 200 through a forward-scanning switching unit 311. The output terminal OUT of the $(i+1)^{th}$ stage of first driving circuit unit 200 is connected to the input terminal IN of the $i^{th}$ stage of first driving circuit unit 200 through a reverse-scanning switching unit 312, where $i \in [1, m-1]$, and i is an integer. In this way, when performing the forward scanning, the forward-scanning switching unit receives an effective level and the reverse-scanning switching unit receives a cut-off level, so that the first driving circuit performs forward scanning. Similarly, when performing the reverse scanning, the reverse-scanning switching unit receives an effective level and the forward-scanning switching unit receives the cut-off level, so that the first driving circuit performs the reverse scanning. In particular, in the third period T3, a reverse-scanning signal controlling line 3120 provides an effective level and a forward-scanning signal controlling line 3110 provides a cut-off level, so that the reverse-scanning switching unit receives the effective level and the forward-scanning switching unit receives the cut-off level, and at this time the first driving circuit performs reverse scanning. In the fourth period T4, the forward-scanning signal controlling line 3110 provides an effective level and the reverse-scanning signal controlling line 3120 provides a cut-off level, so that the forward-scanning switching unit receives the effective level and the adverse-scanning switching unit receives the cut-off level, and at this time the first driving circuit performs forward scanning.

Further, generally the forward scanning and the reverse scanning require separate start signals for staring the scanning, and thus an additional start signal line is required. Moreover, the driving circuit needs to perform timing sequence matching so that the start signal for starting the forward scanning is inputted just after the reverse scanning has completed, and such timing sequence matching is very difficult. Therefore, an embodiment of the present disclosure provides a technical solution, in which a first dummy driving circuit unit Dummy is arranged to precede the $1^{st}$ stage of first driving circuit unit 200. The first dummy driving circuit unit Dummy has an input terminal IN connected to the output terminal OUT of the $1^{st}$ stage of driving circuit unit through the reverse-scanning switching unit 312, and an output terminal OUT connected to the input terminal IN of the $1^{st}$ stage of driving circuit unit through the forward-scanning switching unit 311.

Further, in the third period T3, only a portion of the third display area AA3 needs to be driven, and the third display area AA3 and the first portion AA1*a* of the first display area AA1 are connected to one set of scan lines. Thus, a data signal is also written into the first portion AA1*a* of the first display area AA1 during the third period T3. The data signal at this time is a parasitic capacitance of the first data line 11, not a real data signal, and thus a display error will occur. Therefore, the scan lines include a fourth set of scan lines 71*a* arrange in the first portion of the first display area and a fifth set of scan lines 71*b* arranged in the third display area. Each scan line of the fourth set of scan lines 71*a* and each scan line of the fifth set of scan lines 71*b* are connected in a one-to-one correspondence by a switch unit 90. The switch unit 90 is turned off in the third period and turned on in the fourth period. The switching unit 90 has a gate connected to a switch signal line 901.

The driving method in this embodiment will be described in the following with reference to the FIG. 16.

In the third period T3, the first control signal line 511 continuously outputs an effective level, the second control signal line 512 continuously outputs a cut-off level, the switch signal line 901 continuously outputs a cut-off level, the forward-scanning signal controlling line 3110 outputs a cut-off level, and the reverse-scanning signal controlling line 3120 outputs an effective level. At this time, a portion of the third display area is driven; and the scan signal drives only the third display area.

In the fourth period T4, the first control signal line 511 continuously outputs a cut-off level, the second control signal line 512 continuously outputs an effective level, the switch signal line 901 continuously outputs an effective level, the forwarding-scanning signal controlling line 3110 outputs an effective level, and the adverse-scanning signal controlling line 3120 outputs a cut-off level. At this time, the first portion AA1*a* of the first display area and another portion of the third display area are simultaneously driven.

In the fifth period T5, the first control signal line 511 continuously outputs a cut-off level, the second control signal line 512 continuously outputs a cut-off level, the switch signal line 901 continuously outputs a cut-off level, the forwarding-scanning signal controlling line 3110 outputs a cut-off level, and the reverse-scanning signal controlling line 3120 outputs a cut-off level. At this time, the second portion AA1*b* of the first display area and the second display area AA2 are simultaneously driven, and the fourth display area AA4 is driven simultaneously with the second portion AA1*b* of the first display area and the second display area AA2 during at least a portion of the fifth period T5.

In this embodiment, it can be seen that the signals of the second control signal line 512, the switch signal line 901, and the forwarding-scanning signal controlling line 3120 have the same waveform and can be reused. Therefore, the number of signal lines can be reduced, and thus the layout difficulty can be reduced, which is advantageous for achieving a narrow border.

Figure 17:
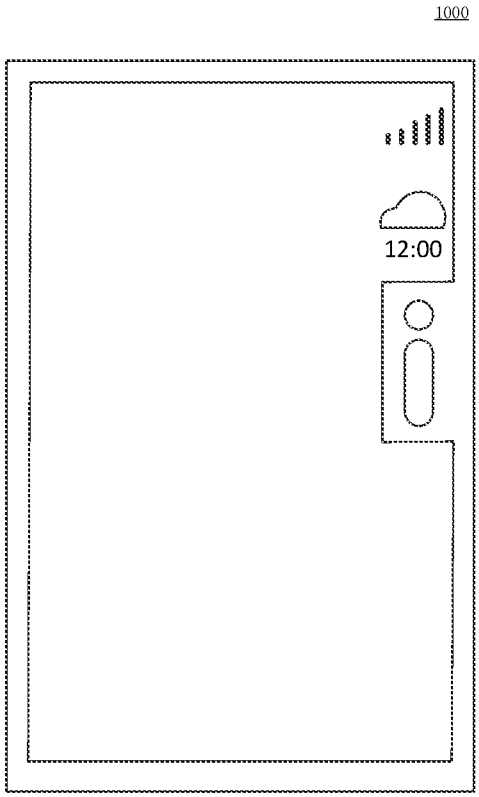
FIG. 17 is a schematic diagram of a display device according to an embodiment of the present disclosure.

FIG. 17 is a schematic diagram of a display device according to an embodiment of the present disclosure. With reference to FIG. 17, an embodiment of the present disclosure further provides a display device, and the display device may include the display panel described above. The display device includes, but not limited to, a cellular mobile telephone 1000, a tablet computer, a display of a computer, a display applied on a smart wearable device, a display device applied on a vehicle such as a car, and the like. As long as the display device includes the display panel included in the display device disclosed in the present disclosure, it shall fall within the scope of the present disclosure.

The above-described embodiments are merely preferred embodiments of the present disclosure and are not intended to limit the present disclosure. Any modifications, equivalent substitutions and improvements made within the principle of the present disclosure shall fall into the protection scope of the present disclosure.

What is claimed is:

1. A display panel, having a display area and a non-display area surrounding the display area, wherein the display area has a first side and a second side opposite to the first side, and the display area comprises:

a hollow area having a first edge and a second edge;

a first display area extending from the first side of the display area to the second side of the display area;

a second display area extending from the first side of the display area to an extension line of the second edge of the hollow area;

a third display area extending from the extension line of the second edge and the second edge of the hollow area to the second side of the display area; and a fourth display area extending from the first side of the display area to the first edge of the hollow area, wherein the display panel comprises:

a driving chip arranged in the non-display area close to the first side of the display area;

first data lines arranged in the first display area, wherein each of the first data lines extends from the first side of the display area to the second side of the display area;

second data lines arranged in the second display area;

third data lines arranged in the third display area; and fourth data lines arranged in the fourth display area, wherein the first edge of the hollow area is close to the driving chip and the second edge of the hollow area is away from the driving chip, and wherein each of the second data lines is electrically connected to n third data lines of the third data lines through a set of signal switching circuits in such a manner that a signal on said second data line is transmitted to n third data lines in a time division manner via the set of signal switching circuits, wherein n is an integer equal to or larger than 2 and no larger than a total number of the third data lines.

2. The display panel according to claim 1, further comprising compensation capacitors connected to the fourth data lines, each of the compensation capacitors has a capacitance of C1, wherein a difference between a parasitic capacitance of each of the first data lines and a parasitic capacitance of each of the second data lines is C2, and $0.8*C2 \leq C1 \leq 1.2*C2$.

3. The display panel according to claim 2, wherein the compensation capacitors are arranged at the first edge of the hollow area close to the fourth display area.

4. The display panel according to claim 1, wherein the set of signal switching circuits comprise n transistors and n control signal lines, each of the n transistors has a first terminal connected to one of the second data lines, a second terminal connected to one of the n third data lines, and a control terminal connected to one of the n control signal lines.

5. The display panel according to claim 4, wherein one of the second data lines corresponds to a set of signal switching circuits, and the signal switching circuits are arranged at the second edge of the hollow area close to the third display area, or one of the second data lines corresponds to a set of signal switching circuits, and the signal switching circuits are arranged between the n third data lines connected to said second data line.

6. The display panel according to claim 5, further comprising:

a plurality of pixels, each having an anode, a cathode, and a light-emitting material layer arranged between the anode and the cathode; and a plurality of pixel driving circuits, each of the plurality of pixel driving circuits corresponding to one of the plurality of pixels and being connected to the anode of the one pixel;

each of the plurality of pixel driving circuits located in the third display area has a size smaller than a size of each of the plurality of pixel driving circuits located in the first display area;

the anode covers at least a portion of the signal switching circuit.

7. The display panel according to claim 4, wherein the display area has a third side adjacent to the first side and the second side, and a fourth side opposite to the third side;

the hollow area is arranged at the third side of the display area and forms a notch area;

each of the n control signal lines extends towards the third side of the display area, and extends from the non-display area close to the third side of the display area to the driving chip.

8. The display panel according to claim 4, wherein the display area has a third side adjacent to the first side and the second side, and a fourth side opposite to the third side;

the hollow area is arranged in a middle area of the display area and forms a non-display hole;

the n control signal lines comprise a first control signal line extending towards the third side, and a second control signal line extending towards the fourth side, the first control signal line extends from the non-display area close to the third side to the driving chip, and the second control signal line extends from the non-display area close to the fourth side to the driving chip.

9. The display panel according to claim 4, wherein the set of signal switching circuits comprises a first transistor and a second transistor;

wherein a first electrode of the first transistor and a first electrode of the second transistor are both connected to one of the second data lines;

wherein the first transistor has a second electrode connected to one third data line in a first group of third data lines, and the second transistor has a second electrode connected to one third data line in a second group of third data lines that is adjacent to the one third data line in the first group of third data lines;

wherein the first transistor has a gate connected to a first control signal line, and the second transistor has a gate connected to a second control signal line;

wherein the set of signal switching circuits comprises a linear active layer extending in a first direction, the active layer having a first end and a second end connected to the one third data line in the first group of third data lines and the one third data line in the second group of third data lines respectively, and a middle area of the active layer is connected to one of the second data lines, and wherein each one of the first control signal line and the second control signal line comprises a gate portion extending in a second direction intersecting the first direction and a body portion, the body portion does not overlap the active layer, and the gate portion overlaps the active layer.

10. The display panel according to claim 1, further comprising:

scan lines extending in a first direction and arranged in a second direction; and data lines extending in the second direction and arranged in the first direction, wherein the display area has a third side adjacent to the first side and the second side, and a fourth side opposite to the third side; the hollow area is arranged at the third side and forms a notch area; and the notch area has a third edge adjacent to both the first edge and the second edge;

wherein in the first direction, the first display area is adjacent to the fourth side of the display area, the second display area is arranged between the first display area and the third edge of the notch area, the third display area is arranged between the first display area and the third side of the display area, and the fourth display area is arranged between the third edge of the notch area and the third side of the display area;

the first display area comprises a first portion aligned with the third display area in the first direction, and a second portion aligned with the second display area in the first direction;

wherein in a first period, the first portion of the first display area and the third display area are simultaneously driven;

wherein in a second period, the second portion of the first display area and the second display area are simultaneously driven; and the fourth display area is driven simultaneously with the second portion of the first display area and the second display area during at least a portion of the second period.

11. The display panel according to claim 10, wherein the scan lines comprise a first set of scan lines, a second set of scan lines, and a third set of scan lines; the first set of scan lines is arranged in the first portion of the first display area and the third display area, the second set of scan lines is arranged in the second portion of the first display area corresponding to the notch area and a portion of the second display area corresponding to the notch area; the third set of scan lines is arranged in the fourth display area and the second portion of the first display area corresponding to the fourth display area and a portion of the second display area corresponding to the fourth display area;

wherein a number of pixels connected to the second set of scan lines are smaller than a number of pixels connected to the first set of scan lines, and the number of pixels connected to the second set of scan lines are smaller than a number of pixels connected to the third set of scan lines; and wherein the second set of scan lines is connected to a load compensation portion.

12. The display panel according to claim 10, wherein a first non-display area is arranged at a side of the first display area close to the driving chip, and the first non-display area has a multiplexing circuit provided therein; and wherein the multiplexing circuit is turned on in the first period and turned off in the second period.

13. The display panel according to claim 10, wherein in the first display area, the data lines located in the first portion are connected to the data lines located in the second portion in a one-to-one correspondence via active layer resistance lines.

14. The display panel according to claim 10, wherein a first driving circuit is provided in the non-display area of the display panel for driving the first portion of the first display area and the third display area, and a second driving circuit is provided in the non-display area for driving the second portion of the first display area, the second display area and the fourth display area;

wherein the first driving circuit is configured to be provided with a first start signal and a first clock signal, and the second driving circuit is configured to be provided with a second start signal and a second clock signal;

wherein in the first period, the first start signal and the first clock signal are provided, and the first driving circuit performs driving row by row; and wherein in the second period, the second start signal and the second clock signal are provided, and the second driving circuit performs driving row by row.

15. The display panel according to claim 14, wherein a width of an effective level of the first start signal is larger than a width of an effective level of the second start signal, and a cycle of the first clock signal is equal to twice a cycle of the second clock signal.

16. The display panel according to claim 10, wherein the set of signal switching circuits comprises a first transistor and a second transistor;

wherein a first electrode of the first transistor and a first electrode of the second transistor are both connected to one of the second data lines;

wherein the first transistor has a second electrode connected to one third data line in a first group of the third data lines, and the second transistor has a second electrode connected to one third data line in a second group of the third data lines adjacent to the one third data line in the first group of the third data lines;

wherein the first transistor has a gate connected to a first control signal line, and the second transistor has a gate connected to a second control signal line;

wherein an effective level of the second control signal line occurs after an effective level of the first control signal line, the effective level of the first control signal line does not overlap an effective level of the scan line, and wherein the effective level of the scan line covers the effective level of the second control signal line.

17. The display panel according to claim 1, further comprising:

scan lines extending in a first direction and arranged in a second direction; and data lines extending in the second direction and arranged in the first direction, wherein the display area has a third side adjacent to the first side and the second side, and a fourth side opposite to the third side; the hollow area is arranged at the third side and forms a notch area; the notch area has a third edge adjacent to both the first edge and the second edge;

wherein in the first direction, the first display area is close to the fourth side of the display area, the second display area is arranged between the first display area and the third edge of the notch area, the third display area is arranged between the first display area and the third side of the display area, and the fourth display area is arranged between the third edge of the notch area and the third side of the display area;

wherein the first display area comprises a first portion aligned with the third display area in the first direction, and a second portion aligned with the second display area in the first direction;

wherein in a third period, a portion of the third display area is driven;

wherein in a fourth period, the first portion of the first display area and another portion of the third display area are simultaneously driven; and wherein in a fifth period, the second portion of the first display area and the second display area are simultaneously driven, and the fourth display area is driven simultaneously with the second portion of the first display area and the second display area during at least a portion of the fifth period.

18. The display panel according to claim 17, wherein a first driving circuit is provided in the non-display area of the display panel for driving the first portion of the first display area and the third display area, and a second driving circuit is provided in the non-display area for driving the second portion of the first display area, the second display area and the fourth display area;

wherein in the third period, the first driving circuit outputs a driving signal stage by stage in a direction along which the second edge of the notch area points to the second side of the display area; and wherein in the fourth period, the first driving circuit outputs a driving signal stage by stage in a direction along which the second side of the display area points to the second edge of the notch area.

19. The display panel according to claim 18, wherein the first driving circuit comprises a first to a m-th stages of first driving circuit units in a direction along which the second edge of the notch area points to the second side of the display area;

wherein each of the first driving circuit units has an output terminal and an input terminal;

wherein the output terminal of an $i^{th}$ stage of first driving circuit unit is connected to the input terminal of an $(i+1)^{th}$ stage of first driving circuit unit through a forward-scanning switching unit; and the output terminal of the $(i+1)^{th}$ stage of first driving circuit unit is connected to the input terminal of the $i^{th}$ stage of first driving circuit unit through a reverse-scanning switching unit, where $i \in [1, m-1]$, and i is an integer, and wherein a first dummy driving circuit unit is arranged to precede a $1^{st}$ stage of first driving circuit unit; the first dummy driving circuit unit has an input terminal connected to the output terminal of the $1^{st}$ stage of driving circuit unit through the reverse-scanning switching unit, and an output terminal connected to the input terminal of the $1^{st}$ stage of driving circuit unit through the forward-scanning switching unit.

20. The display panel according to claim 17, wherein the scan lines comprise a fourth set of scan lines arranged in the first portion of the first display area and a fifth set of scan lines arranged in the third display area;

wherein each scan line in the first group of scan lines and each scan line in the second group of scan lines are connected in a one-to-one correspondence via a switch unit;

wherein in a third period, the switch unit is turned off; and wherein in a fourth period, the switch unit is turned on.

21. A display device, comprising a display panel having a display area and a non-display area surrounding the display area, wherein the display area has a first side and a second side opposite to the first side, and the display area comprises:

a hollow area having a first edge and a second edge;

a first display area extending from the first side of the display area to the second side of the display area;

a second display area extending from the first side of the display area to an extension line of the second edge of the hollow area;

a third display area extending from the extension line of the second edge and the second edge of the hollow area to the second side of the display area; and a fourth display area extending from the first side of the display area to the first edge of the hollow area, wherein the display panel comprises:

a driving chip arranged in the non-display area close to the first side of the display area;

first data lines arranged in the first display area, wherein each of the first data lines extends from the first side of the display area to the second side of the display area;

second data lines arranged in the second display area;

third data lines arranged in the third display area; and fourth data lines arranged in the fourth display area, wherein the first edge of the hollow area is close to the driving chip and the second edge of the hollow area is away from the driving chip, and each of the second data lines is electrically connected to at least two of the third data lines through a set of signal switching circuits in such a manner that a signal on said second data line is transmitted to n third data lines in a time division manner via the set of signal switching circuits, wherein n is an integer equal or larger than 2 and not larger than a total number of the third data lines.

* * * * *